US006174190B1

(12) United States Patent
Tharp et al.

(10) Patent No.: US 6,174,190 B1
(45) Date of Patent: Jan. 16, 2001

(54) CONNECTOR HAVING A SLIDE RAIL LATCH RELEASE

(76) Inventors: Keith Frank Tharp, 1014 Normington Way, San Jose, CA (US) 94136; Brian Todd Mincemoyer, 1023 Shakespeare Ave., Milton, PA (US) 17847

( * ) Notice: Under 35 U.S.C. 154(b), the term of this patent shall be extended for 0 days.

(21) Appl. No.: 09/427,329

(22) Filed: Oct. 26, 1999

Related U.S. Application Data

(60) Provisional application No. 60/152,807, filed on Sep. 8, 1999.

(51) Int. Cl.[7] ..... H01R 13/627
(52) U.S. Cl. ..... 439/352
(58) Field of Search ..... 439/352, 357, 439/353, 358, 354, 355, 356, 140

(56) References Cited

U.S. PATENT DOCUMENTS

| | | | | |
|---|---|---|---|---|
| 4,370,013 | * | 1/1983 | Niitsu et al. | 339/82 |
| 4,995,826 | | 2/1991 | Schieferly | 439/347 |
| 5,217,390 | * | 6/1993 | Nozaki et al. | 439/489 |
| 5,219,300 | * | 6/1993 | Yagi et al. | 439/532 |
| 5,234,356 | * | 8/1993 | Maejima et al. | 439/352 |
| 5,255,154 | | 10/1993 | Hosoi et al. | 361/680 |
| 5,292,258 | * | 3/1994 | Sakurai | 439/352 |
| 5,338,219 | * | 8/1994 | Hiramoto et al. | 439/350 |
| 5,399,109 | | 3/1995 | Sedig | 439/701 |
| 5,487,678 | * | 1/1996 | Tsuji et al. | 439/352 |
| 5,554,044 | * | 9/1996 | Nishide | 439/352 |
| 5,619,604 | * | 4/1997 | Shiflett et al. | 385/59 |
| 5,624,272 | * | 4/1997 | Ohsumi | 439/353 |
| 5,628,648 | * | 5/1997 | Higgins, Jr. et al. | 439/489 |
| 5,639,992 | | 6/1997 | Debbaut | 174/84 |
| 5,725,324 | | 3/1998 | Pavelski | 403/321 |
| 5,785,540 | | 7/1998 | Jaklin | 439/157 |
| 5,856,646 | | 1/1999 | Simon | 200/600 |
| 5,879,180 | * | 3/1999 | Iwahori et al. | 439/352 |
| 5,947,776 | | 9/1999 | Epe | 439/752 |
| 5,956,444 | * | 9/1999 | Duda et al. | 385/53 |
| 5,980,297 | * | 11/1999 | Sugle | 439/354 |
| 6,017,153 | * | 1/2000 | Carlisle et al. | 385/56 |

* cited by examiner

*Primary Examiner*—Paula Bradley
*Assistant Examiner*—Phuongchi Nguyen
(74) *Attorney, Agent, or Firm*—Duane, Morris & Heckscher LLP

(57) ABSTRACT

A latch release is provided for engaging a latching mechanism of a connector. The latch release includes a housing cooperatively associated with the connector having a passageway that defines a first open end and a second open end. The second open end of the passageway is positioned adjacent to an operative portion of the latching mechanism. A rail is slidably positioned within the passageway and includes a front end that projects outwardly from the second open end of the passageway adjacent to the operative portion of the latching mechanism. A rear end of the rail projects outwardly from the first open end of the passageway so that when the rail is slid through the passageway, the front end of the rail engages the operative portion of the latching mechanism thereby releasing the connector. A method of unlatching a connector is also disclosed.

15 Claims, 5 Drawing Sheets

CONNECTOR HAVING A SLIDE RAIL LATCH RELEASE

This application claims priority from a Provisional Patent Application entitled Latching Slide Rail, filed by the same inventors on Sep. 8, 1999, and accorded Ser. No. 60/152,807.

FIELD OF THE INVENTION

The present invention generally relates to electrical interconnection devices, and more particularly to mechanisms used to secure and release such devices to and from each other.

BACKGROUND OF THE INVENTION

Electrical connectors typically have a multiplicity of terminal contacts positioned in an insulating housing, and arranged so as to be connected to a complementary connector to form a connector pair. It is well known to use mechanical latching mechanisms for maintaining the connection between the two connectors. These mechanical latching mechanisms have been heretofore designed as either actuating slides or as one or more inter-engaging levers positioned on each connector of the pair. Examples of connectors utilizing such devices may be found in U.S. Pat. Nos.: 5,947,776, 5,785,540, 5,725,324, 5,399,109, 5,255,154, and 4,995,826. European Patent No. EP587174 A2 also discloses a slide mechanism that is consistent with the prior art.

In such prior art devices, the actuating slide is integrated in one of the connectors in either a guide groove or a guide slot, with the second connector of the pair having the complementary mating portion of the latching mechanism. Typically, when the connectors are mated, the actuating slide causes a lug or the like to move through the guide groove or the guide slot so as to secure the connector pair together. Very often the actuating slides are moved in a transverse direction with respect to the insertion direction of the connectors. This arrangement is not always satisfactory, especially when it is used in conjunction with multiple connectors that are positioned either side-by-side or stacked one above the other.

There is a need in the art for connectors that can be released from one another when the latching mechanism is located in a remote position, or in an arrangement with other connector pairs that provides little or no space for actuation. This need in the art has become acute in connection with many "high density" interconnection systems, where unlatching must take place under difficult circumstances, e.g., in a blind space where several such connectors are arranged in a stacked configuration.

SUMMARY OF THE INVENTION

The present invention provides a latch release for engaging an operative portion of a latching mechanism of a connector to switch the latching mechanism between a latched position and an unlatched position. In a preferred embodiment, the latch release includes a housing cooperatively associated with the connector and having a passageway therethrough that defines a first open end and a second open end. The second open end of the passageway is positioned adjacent to the operative portion of the latching mechanism. A rail is slidably positioned within the passageway and comprises a front end that projects outwardly from the second open end of the passageway adjacent to the operative portion of the latching mechanism. A rear end of the rail projects outwardly from the first open end of the passageway so that when the rail is slid through the passageway, the front end of the rail engages and actuates the operative portion of the latching mechanism.

A method of releasing a latched connector is also provided that comprises positioning a rail in slidable relation to a passageway defined through a portion of the connector so as to be engagable with an operative portion of a latching mechanism and sliding the rail into engagement with the operative portion of the latching mechanism so as to unlatch the connector.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

The following description of the preferred embodiments of the invention are intended to be read in connection with the foregoing drawings and are to be considered a portion of the entire written description of this invention. As used in the following description, terms such as, "horizonal", "vertical", "up", "down", "top" and "bottom" as well as adjectival and adverbial derivatives thereof (e.g., "horizontally", "downwardly", "upwardly", etc.) simply refer to the orientation of the structure of the invention as it is illustrated in the particular drawing figure when that figure faces the reader. Similarly, the terms "inwardly" and "outwardly" generally refer to the orientation of a surface relative to its axis of elongation, or axis of rotation, as appropriate. Also, the terms "connected" and "interconnected", when used in this disclosure to describe the relationship between two or more structures, mean that such structures are secured or attached to each other either directly or indirectly through intervening structures, and include pivotal connections. The term "operatively connected" means that the foregoing direct or indirect connection between the structures allows such structures to operate as intended by virtue of such connection.

Figure 1:
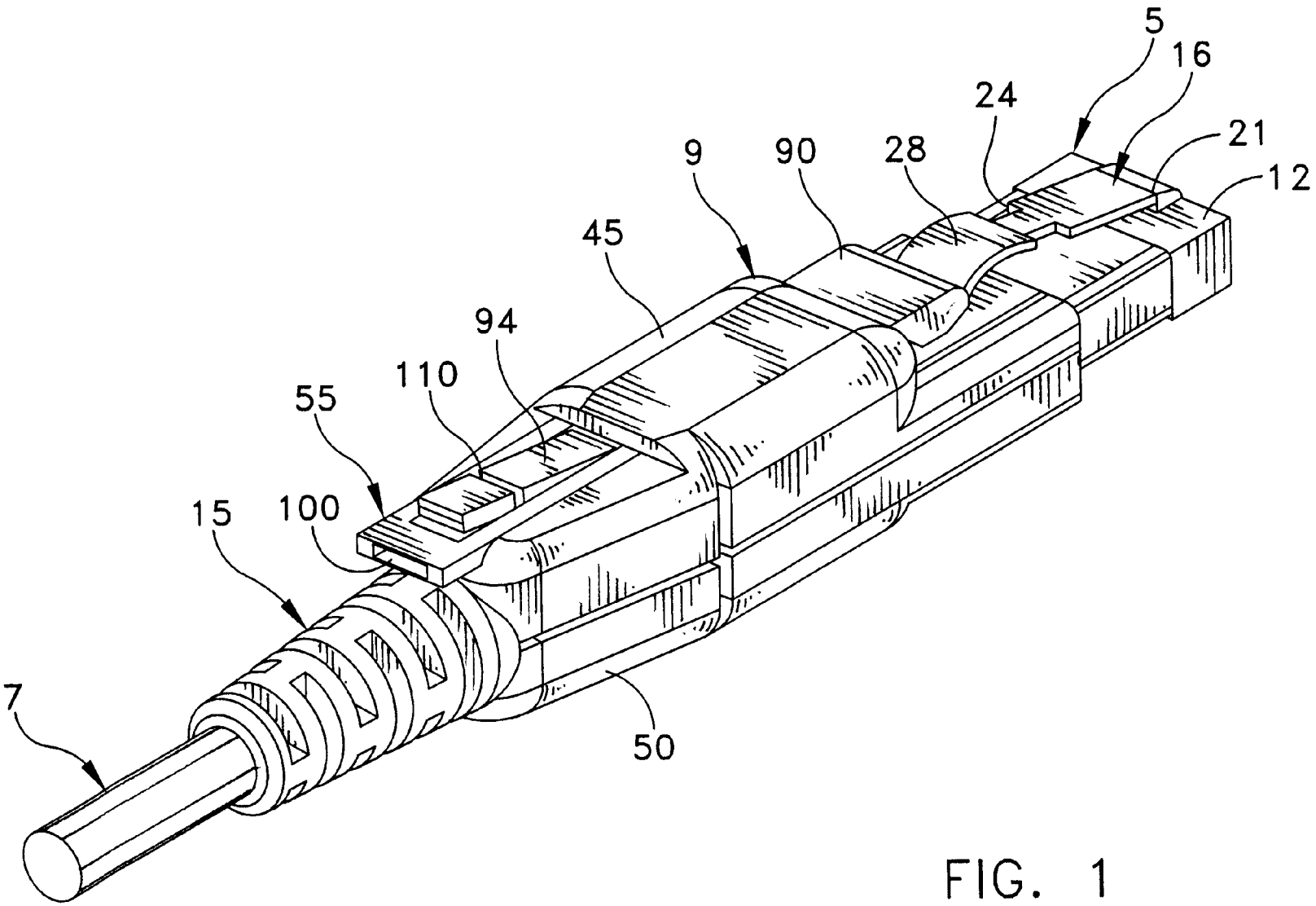
FIG. 1 is a perspective view of an electrical connector having a slide rail latch formed according to the present invention.

FIG. 1 shows an electrical connector 5 terminated to the end of a cable 7 and having a shield housing 9 formed according to the present invention. Electrical connector 5 may comprise any of the well known high density interconnection devices that are designed to meet the ANSI X3T11 standard, such as the HSSDC connectors marketed by AMP Inc., Berg Electronics, Inc., Amphenol Inc., or other HSSDC or similar high density electrical interconnection devices known in the art. Connectors of this type typically include a plurality of closely spaced, electrically conductive pin or receptacle contacts (not shown) arranged within an insulative housing 12, and individually terminated at one end 13 to a corresponding plurality of conductors (not shown) that form the central portion of cable 7. The electrical interconnection features of the plurality of closely spaced pin or receptacle contacts are positioned adjacent to an interface surface 14 of the connector. A cable strain relief 15 is often slipped over the outer portion of cable 7 to reduce the stress and strain placed on the individual wire terminations during handling and use of electrical connector 5.

Figure 2:
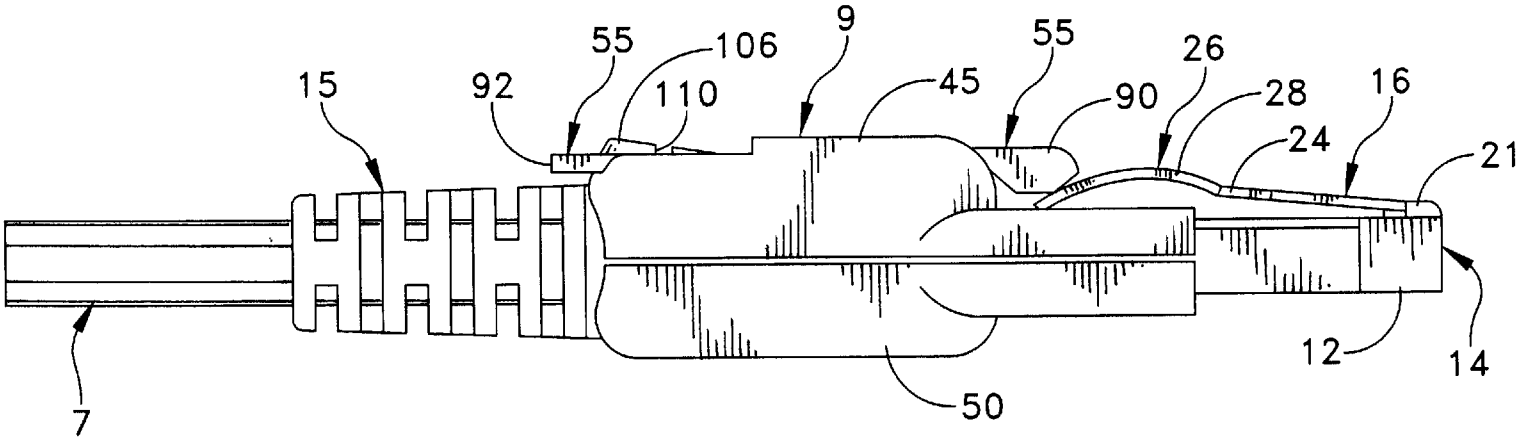
FIG. 2 is a side elevational view of the connector shown in FIG. 1.

Housing 12 of electrical connector 5 is typically formed from one of the well known polymer materials that are suitable for injection molding, e.g., polyhalo-olefins, polyamides, polyolefins, polystyrenes, polyvinyls, polyacrylates, polymethacrylates, polyesters, polydienes, polyoxides, polyamides and polysulfides and their blends, co-polymers and substituted derivatives thereof. Housing 12 also normally includes a resilient latch 16 positioned on an outer surface, and arranged to releasably engage a corresponding feature on a mating electrical connector 18 that may be mounted on the edge of a printed wiring board 20, as shown for example in FIGS. 8 and 9. Latch 16 may comprise various known shapes and include several alternative features that are adapted for releasably engaging a corresponding feature on a mating electrical connector 18, e.g., recesses, notches, shoulders, catches, or tabs, etc. FIGS. 1 and 2 show a representative latch 16 that includes a recessed portion 24, that is adapted to engage a corresponding protrusion or the like (not shown) on a mating connector 18.

Typically, latch 16 will comprise a cantilevered beam that is fixed, via a living hinge 21 or the like, at a first end 22 that is adjacent to interface surface 14. Latch 16 extends rearwardly from first end 22 toward cable 7, and at an acute angle relative to the top surface of housing 12. In this way, depressing latch 16 toward the top surface of housing 12 stores elastic energy in living hinge 21 so that when released, latch 16 springs away from the top surface of housing 12 and toward its original unloaded position.

Figure 8:
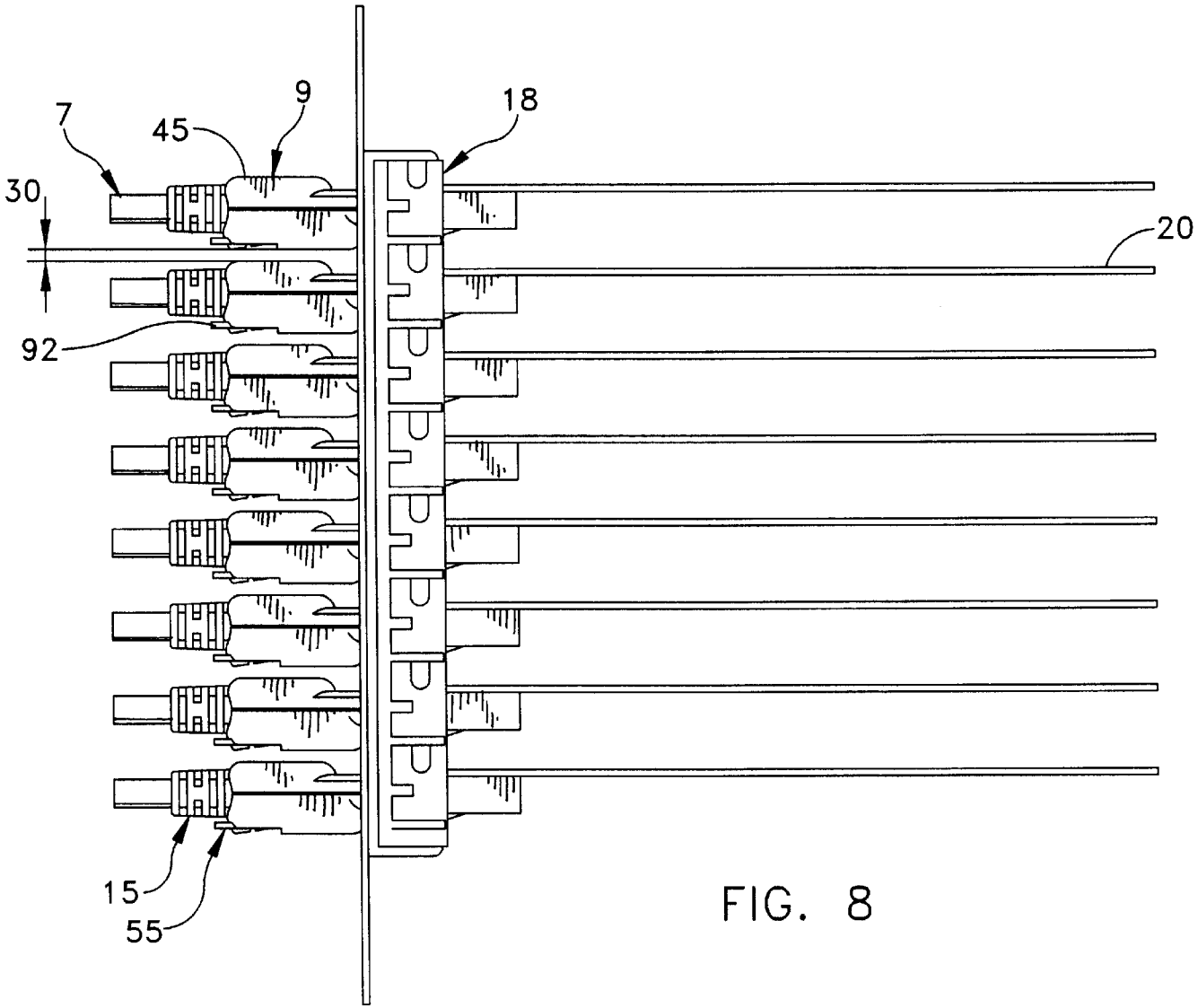
FIG. 8 is a side elevational view of a plurality of electrical connectors, each having a slide rail latch formed according to the present invention and mated in a stacked configuration to corresponding connectors.
Figure 9:
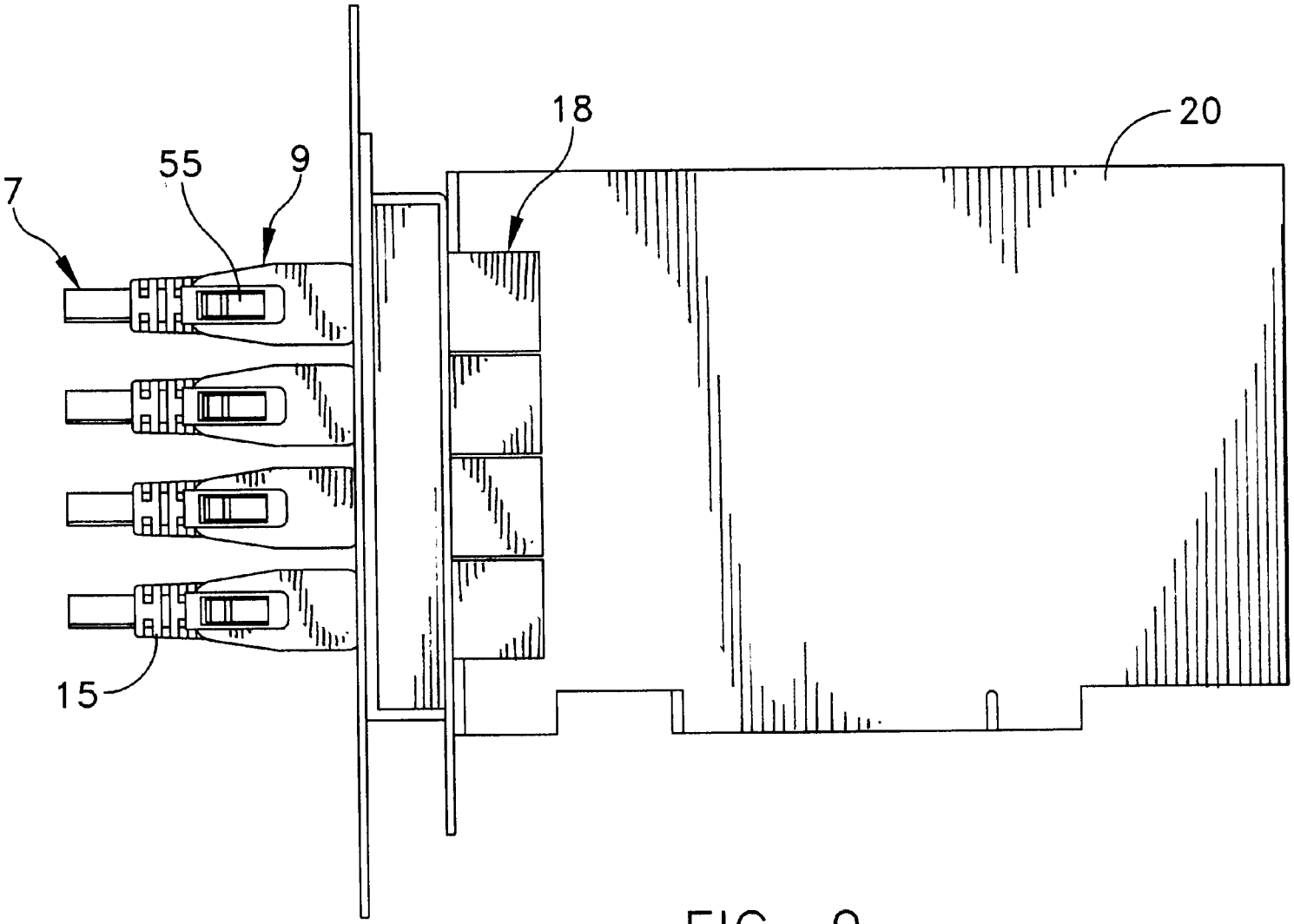
FIG. 9 is a side elevational view of a plurality of electrical connectors, each having a slide rail latch formed according to the present invention and mated in a side-by-side configuration to corresponding connectors.

Terminal end 26 of latch 16 often includes a raised feature that is adapted for aiding in depressing latch 16, such as is generally represented by radiused portion 28. Radiused portion 28 may take various known shapes so long as it is arranged so that a finger or tool may depress it to release latch 16 from engagement with mating connector 18. For example, when connectors 5 and 18 are mated together, as shown in FIGS. 8 and 9, radiused portion 28 may be depressed, thus disengaging recessed portion 24 from a corresponding latching protrusion (not shown) on mating connector 18. However, as is illustrated best in FIG. 8, due to the high density requirements placed on such connectors, little or no space (shown generally at reference numeral 30) is available for the insertion of a person's finger or tool to depress latch 16 and thereby release connector 5 from connector 18, as intended by the design. This situation is often acute in applications that require a plurality of interconnection devices to be engaged to the same circuit board in a closely spaced architecture.

Figure 3:
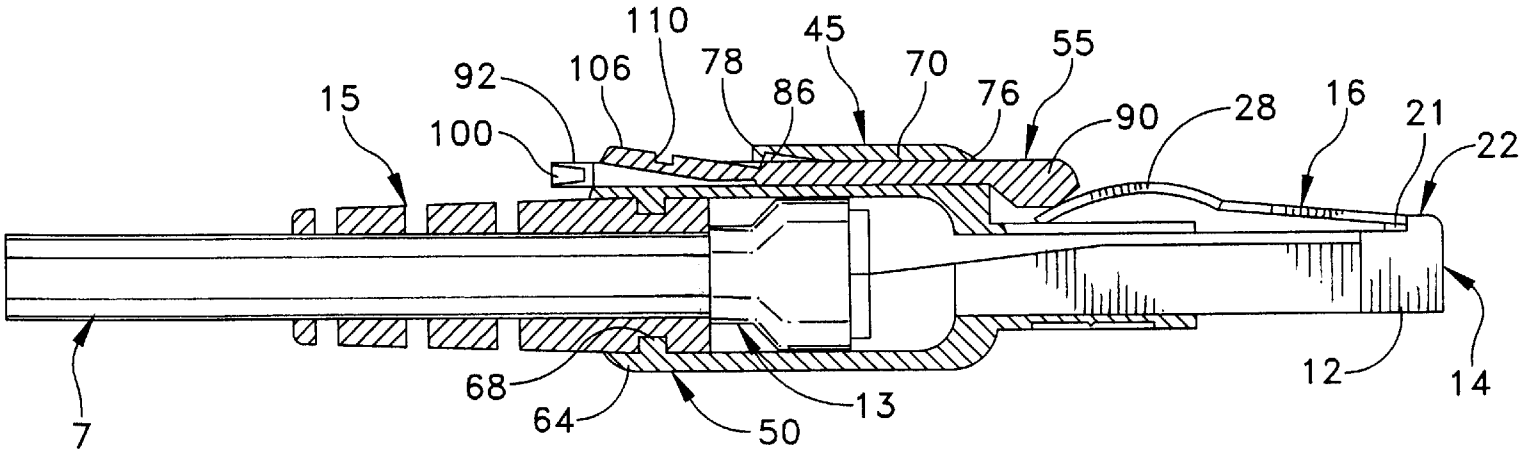
FIG. 3 is a cross-sectional view of the connector shown in FIG. 2.
Figure 4:
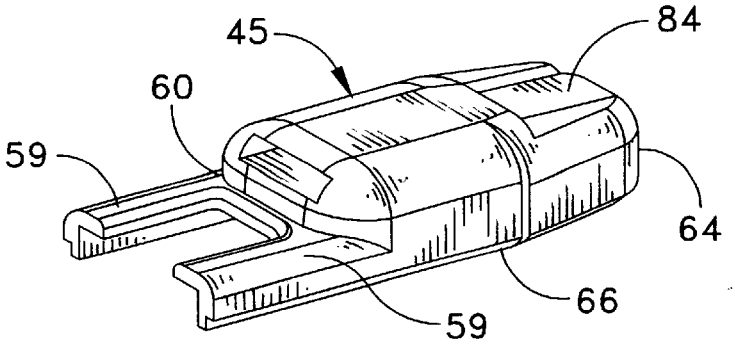
FIG. 4 is a perspective view of a top shell portion of the connector shown in FIG. 1.

The present invention solves this problem in the art by providing a shield housing 9 comprising a top shell 45, a bottom shell 50, and a slide rail 55 that are advantageously arranged to aid in the actuation of latch 16. More particularly, top shell 45 and bottom shell 50 each comprise a concavely shaped, complementary body portion having a pair of parallel spaced arms 59 that project outwardly from a front end 60 and a cable exit opening 62 defined at a rear end 64 (FIGS. 2–5). Body portions 57 of top shell 45 and bottom shell 50 may be formed from either a conductive material, e.g., brass, zinc, steel, conductive polymers, etc., or an electrically insulating material, e.g., any of the well-known polymer materials disclosed hereinabove in connection with housing 12. The body portions are designed so as to mate along a peripheral edge 66 to form a partially enclosed void space or cavity that is sized and shaped to contain and cooperate with at least a portion of housing 12, the terminated end of cable 7, and a portion of cable strain relief 15 (FIG. 3). An annular stud 68 projects inwardly from the inner surface of the body portions, adjacent to rear end 64, to engage a corresponding recess in cable strain relief 15 so as to hold cable strain relief 15 securely in place.

Figure 5:
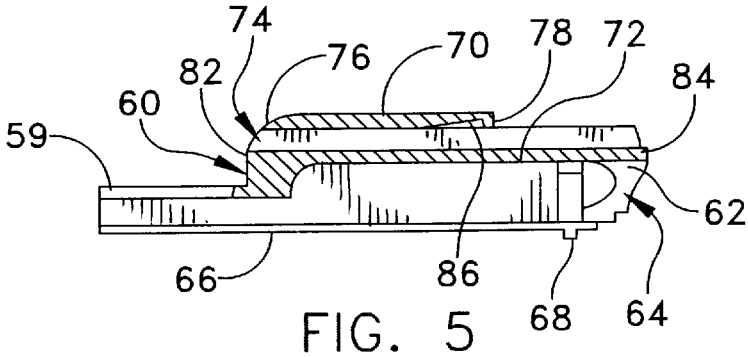
FIG. 5 is a cross-sectional view of the top shell shown in FIG. 4.
Figure 6:
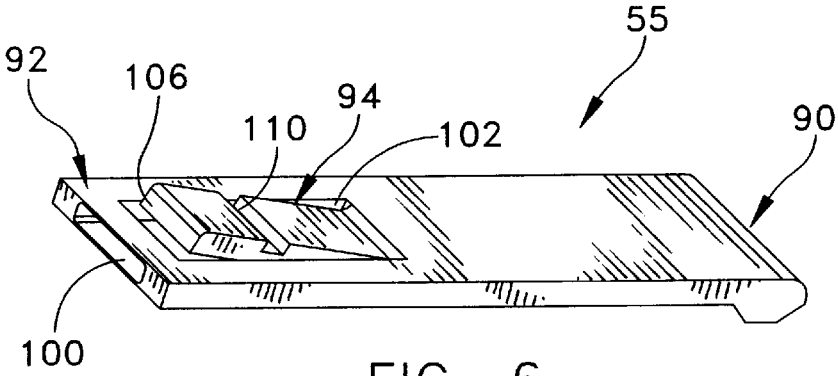
FIG. 6 is a perspective view of a slide rail formed in accordance with the present invention.
Figure 7:
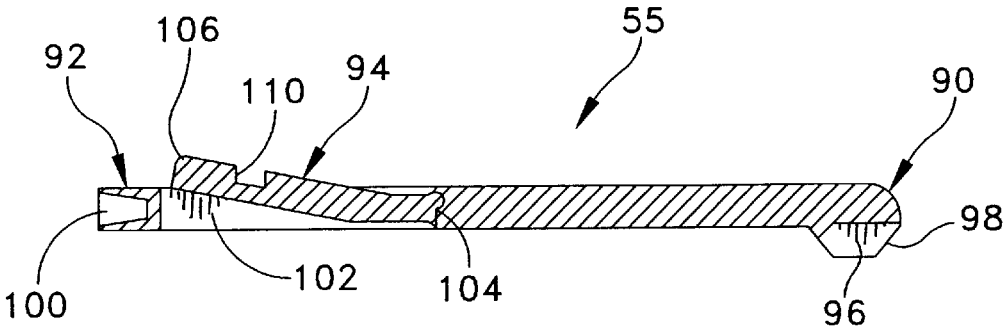
FIG. 7 is a cross-sectional view of the slide rail shown in FIG. 6.

Referring to FIGS. 3 and 5, the body portion of top shell 45 further includes an outer wall 70 and an inner wall 72 that are spaced apart to define an open ended passageway 74. Outer wall 70 includes a front edge 76 and a rear edge 78. A recessed notch 86 is defined in the inner surface of outer wall 70, adjacent to rear edge 78. Inner wall 72 includes a front edge 82 and a rear edge 84. Rear edge 84 is spaced away from the rear opening of passageway 74, adjacent to cable exit opening 62 at rear end 64, so as to provide a rail support surface 84. Passageway 74 preferably comprises a substantially rectangular cross-sectional shape, having a somewhat larger cross-sectional size than slide rail 55, and having openings at front edges 76,82 at front end 60, and at rear edge 78 of outer wall 70.

Referring to FIGS. 2–3 and 6–7, slide rail 55 is slidably positioned within passageway 74, and comprises an elongate, substantially flat beam having a front end 90, a rear end 92, and a catch 94. More particularly, front end 90 includes a cam 96 that projects radially outwardly from a bottom surface of slide rail 55. Cam 96 includes a chamfered front surface 98 that is shaped and sized for sliding engagement with an operative portion of latch 16, e.g., radiused portion 28, as will hereinafter be disclosed in further detail. Rear end 92 includes a tapered recess 100 that extends axially into slide rail 55. Tapered recess 100 is sized so as to accept the working end of a tool, such as a conventional screw driver or knife blade tip.

Catch 94 comprises a cantilevered beam that is formed within a window 102 defined in a rear portion of slide rail 55. Catch 94 is fixed at one end to an edge of window 102 by a living hinge 104 so that free end 106 is positioned above the edges of window 102. In this way, when free end 106 is depressed downwardly, toward window 102, elastic energy is stored in living hinge 104 which, in turn, tends to bias catch 94 outwardly, away from slide rail 55. A recessed notch 110 is defined on the outer surface of catch 94, adjacent to free end 106. Slide rail 55 may be formed from any of the well-known polymer materials disclosed hereinabove in connection with housing 12 or from any other suitably rigid and resilient material, e.g., spring quality metals.

Referring to FIG. 8, when a pair of connectors 5,18 are mated in a stacked configuration, the space 30 available between each connector 5 is particularly narrow such that the radiused portion 28 of each latch 16 may not be easily accessed so as to release latch 16 from engagement with a corresponding latching mechanism on mating connector 18. The present invention allows for the disengagement of latch 16 in the following manner. When connector 5 is in the position shown in FIG. 8, slide rail 55 is positioned within passageway 74 with chamfered surface 98 positioned adjacent to radiused portion 28, but not depressing it. Rear end 92 of slide rail 55 is spaced away from rear edge 78 of outer wall 70, and catch 94 is in an unbiased state with free end 106 positioned above window 102.

To unlatch connector 5 from connector 18, the tip portion of a tool, e.g., a screwdriver, knife blade, etc. (not shown) is positioned in tapered recess 100 of slide rail 55. The tool is then pushed axially against slide rail 55, causing slide rail 55 to slide longitudinally with respect to passageway 74, and toward connector 18. As this happens, chamfered surface 98 engages radiused portion 28 of latch 16 and depresses latch 16 toward the top surface of housing 12. Slide rail 55 thus moves over latch 16, depressing radiused portion 28, and thereby releasing latch 16 from engagement with the corresponding latching mechanism on mating connector 18.

At the same time that slide rail 55 is moving into engagement with radiused portion 28 of latch 16, catch 94 moves toward rear edge 78 of outer wall 70. As rear edge 78 engages catch 94, catch 94 pivots about living hinge 104, toward window 102, and slides into passageway 74. This pivoting movement of catch 94 biases catch 94 against outer wall 70. Slide rail 55 and catch 94 slide into passageway 74 until recessed notch 110 of catch 94 engages recessed notch 86 of outer wall 70. This engagement locks slide rail 55 in position such that cam 96 resides directly over top of radiused portion 28 of latch 16, thereby holding latch 16 in a substantially fully depressed position so that connector 5 can be disengaged from connector 18 by, e.g., pulling on cable 7.

Once connector 5 has been removed from engagement with connector 18, slide rail 55 can be repositioned to its initial starting configuration by merely depressing free end 106 of catch 94 while at the same time pushing front end 90 of slide rail 55 rearwardly toward rear end 64 of the body portion so that catch 94 springs outwardly, via living hinge 104, and away from window 102. It will be understood that the present invention works equally well in a side-by-side connector configuration, as shown in FIG. 9.

It is to be understood that the present invention is by no means limited only to the particular constructions herein disclosed and shown in the drawings, but also comprises any modifications or equivalents within the scope of the claims.

What is claimed is:

1. A latch release for engaging an operative portion of a latching mechanism of a connector so as to switch said latching mechanism between a latched position and an unlatched position comprising:

a housing cooperatively associated with said connector and having a passageway therethrough defining a first open end and a second open end wherein said second open end is positioned adjacent to an operative portion of a latching mechanism; and a rail slidably positioned within said passageway and comprising a front end that projects outwardly from said second open end adjacent to said operative portion of said latching mechanism and a rear end that projects outwardly from said first open end so that when said rail is slid through said passageway toward said latching mechanism said front end of said rail engages said operative portion of said latching mechanism.

2. A latch release according to claim 1 wherein said rail includes an elongate substantially flat beam and wherein said front end includes a cam that projects radially outwardly from a bottom surface, said cam having a chamfered front surface that is shaped and sized for sliding and actuating engagement with said operative portion of said latching mechanism.

3. A latch release according to claim 2 wherein said rear end has a tapered recess that extends into said rail and is sized so as to accept the working end of a push tool.

4. A latch release according to claim 2 wherein said rail defines an opening in a portion of said rear end and within which a catch comprising a cantilevered beam projects upwardly and outwardly from an edge of said opening.

5. A latch release according to claim 4 wherein said catch is fixed to said edge of said opening by a living hinge.

6. A latch release according to claim 5 wherein said catch includes a free end positioned above said opening and a recessed notch defined on an outer surface of said catch adjacent to said free end.

7. A latch release according to claim 1 wherein said housing comprises a top shell and a bottom shell each having a concavely shaped body portion including a pair of parallel spaced arms that project outwardly from a front end and a cable exit opening defined at a rear end.

8. A latch release according to claim 7 wherein said body portions of said top and bottom shells mate along a peripheral edge to form a partially enclosed void space or cavity that is sized and shaped to contain and cooperate with a portion of said connector.

9. A latch release according to claim 8 wherein said body portions of said top and bottom shells include an annular stud that projects inwardly from an inner surface adjacent to said cable exit opening.

10. A latch release according to claim 9 wherein said body portion of said top shell includes an outer wall and an inner wall that are spaced apart so as to define said passageway and wherein said outer wall includes a front edge and a rear edge and has a recessed notch defined within an inner surface, adjacent to said rear edge and said inner wall includes a front edge and a rear edge with said rear edge spaced away from a rear opening of said passageway, adjacent to said cable exit opening at said rear end so as to provide a rail support surface.

11. A latch release according to claim 10 wherein said passageway comprises a substantially rectangular cross-sectional shape, having a somewhat larger cross-sectional size than said rail.

12. A latch release for engaging an operative portion of a latching mechanism of a connector so as to switch said latching mechanism between a latched position and an unlatched position comprising:

a housing cooperatively associated with said connector and having a passageway therethrough defining a first open end and a second open end wherein said second open end is positioned adjacent to an operative portion of a latching mechanism; and a rail slidably positioned within said passageway and comprising a front end that projects outwardly from said second open end adjacent to said operative portion of said latching mechanism and a rear end that projects outwardly from said first open end, wherein said rail defines an opening in a portion of said rear end within which a catch comprising a cantilevered beam projects upwardly and outwardly from an edge of said opening and is fixed to said edge of said opening by a living hinge so that when said rail is slid through said passageway toward said latching mechanism said front end of said rail engages said operative portion of said latching mechanism and said catch engages a portion of said housing so as to maintain said rail in engagement with said operative portion.

13. A latch release according to claim 12 wherein said catch includes a free end positioned above said opening and a recessed notch defined on an outer surface of said catch adjacent to said free end such that when said rail fully engages said operative portion so as to unlatch said latching mechanism, said recessed notch of said catch engages a recessed notch defined on an inner surface of said housing defining said passageway.

14. A latch release according to claim 13 wherein said rail includes an elongate substantially flat beam wherein said front end include a cam that projects radially outwardly from a bottom surface, said cam having a chamfered front surface that is shaped and sized for sliding engagement with said operative portion of said latching mechanism.

15. A latch release according to claim 14 wherein said rear end has a tapered recess that extends into said rail, and is sized so as to accept the working end of a push tool.

* * * * *